US006058564A

United States Patent [19]

Purcell et al.

[11] Patent Number: 6,058,564

[45] Date of Patent: May 9, 2000

[54] ADJUSTABLE HINGE

[75] Inventors: Stephen M. Purcell, Loves Park, Ill.; David R. Cress, Janesville, Wis.

[73] Assignee: Newell Operating Company, Freeport, Ill.

[21] Appl. No.: 09/032,497

[22] Filed: Feb. 26, 1998

[51] Int. Cl.[7] ..... E05D 7/04

[52] U.S. Cl. ..... 16/241; 16/247; 16/235

[58] Field of Search ..... 16/235, 236, 239, 16/240, 241, 247

[56] References Cited

U.S. PATENT DOCUMENTS

| | | | |
|---|---|---|---|
| 609,756 | 8/1898 | Curry | 49/399 |
| 1,111,832 | 9/1914 | Hazelrigg et al. | 16/240 |
| 2,373,955 | 4/1945 | Fuller | 16/240 |
| 2,700,789 | 2/1955 | Cornwell | 16/248 |
| 4,099,293 | 7/1978 | Pittasch . | |
| 4,156,301 | 5/1979 | Schneider et al. | 16/249 |
| 4,159,557 | 7/1979 | Pittasch et al. . | |
| 4,185,357 | 1/1980 | Busse . | |
| 4,411,045 | 10/1983 | Röck et al. . | |
| 4,453,346 | 6/1984 | Powell et al. | 411/546 |
| 4,475,858 | 10/1984 | Benjamin et al. | 470/906 |
| 4,506,409 | 3/1985 | Lautenschläger . | |
| 4,517,706 | 5/1985 | Lautenschläger et al. . | |
| 4,590,641 | 5/1986 | Lautenschläger et al. . | |
| 4,604,769 | 8/1986 | Röck et al. . | |
| 4,615,072 | 10/1986 | Laütenschläger, Jr. . | |
| 4,641,393 | 2/1987 | Lautenschläger . | |
| 4,674,150 | 6/1987 | Salice . | |
| 4,716,622 | 1/1988 | DeBruyn . | |
| 4,718,143 | 1/1988 | Lautenschläger, Jr. . | |
| 5,027,474 | 7/1991 | Bowers . | |
| 5,283,929 | 2/1994 | Lin . | |
| 5,339,493 | 8/1994 | MacIntyre . | |
| 5,340,258 | 8/1994 | Simon | 411/535 |
| 5,500,983 | 3/1996 | Lautenscläger . | |
| 5,603,142 | 2/1997 | Dubach et al. . | |
| 5,621,947 | 4/1997 | Fitz et al. | 16/240 |
| 5,664,288 | 9/1997 | Lautenschläger et al. . | |
| 5,720,082 | 2/1998 | Rossme | 16/244 |

FOREIGN PATENT DOCUMENTS

| | | | |
|---|---|---|---|
| 5-71261 | 3/1993 | Japan | 16/240 |

OTHER PUBLICATIONS

Form No. 272 (Profile SA System 2000 Hinge).

*Primary Examiner*—Chuck Y. Mah
*Assistant Examiner*—Donald M. Gurley
*Attorney, Agent, or Firm*—Foley & Lardner

[57] ABSTRACT

An adjustable cabinet hinge includes a door wing to be mounted on a door, a frame wing to be mounted on a frame and rotatably connected to the door wing, and an adjustment module. The adjustment module includes a substantially cylindrical, externally threaded base portion, an adjustment portion having an external shape that facilitates adjusting of the adjustment module, and an internal cavity extending through the adjustment portion and the base portion for receiving a mounting screw. The frame wing includes an internally threaded aperture configured to mesh with the externally threaded base portion of the adjustment module.

30 Claims, 3 Drawing Sheets

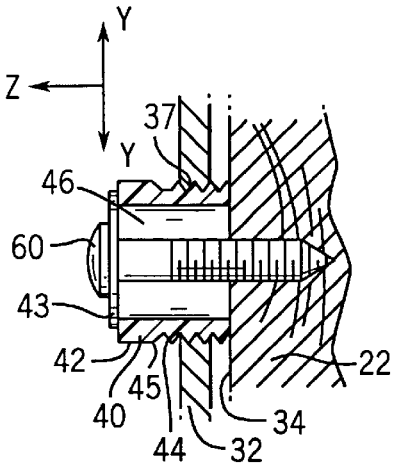
FIG. 6
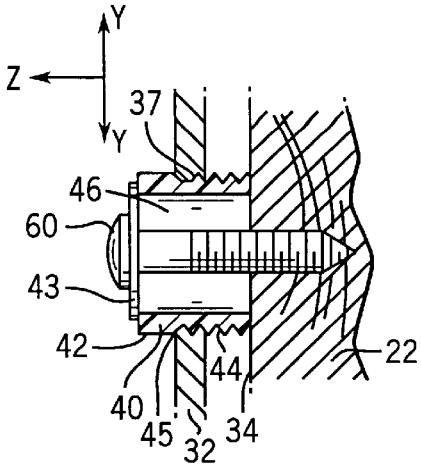
FIG. 7
FIG. 9
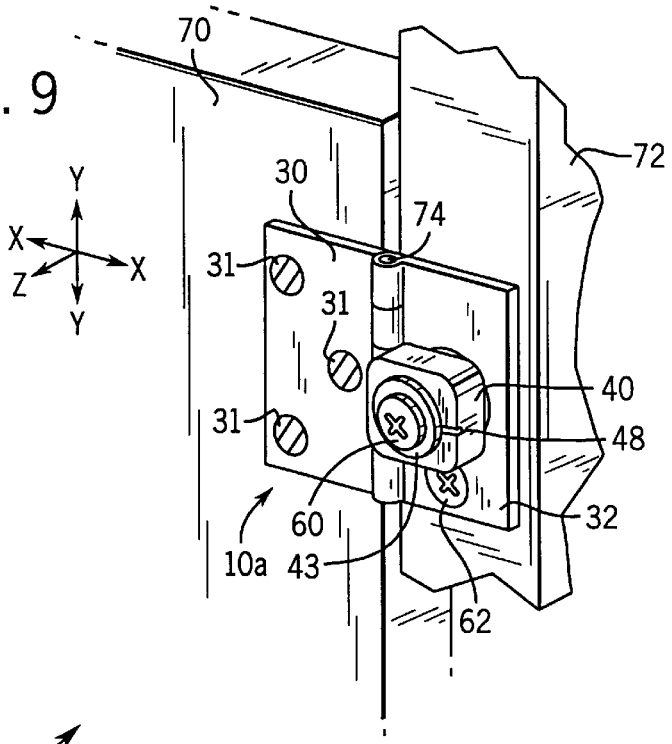
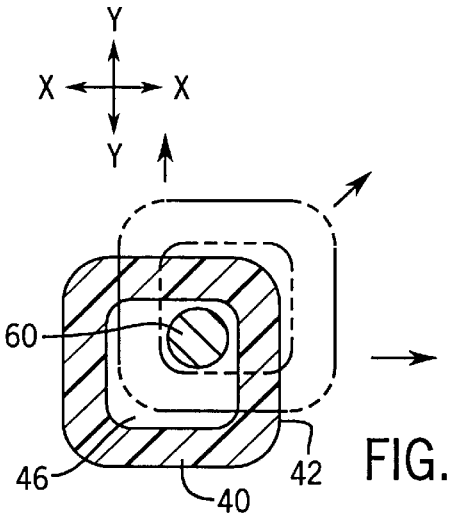
FIG. 8

ADJUSTABLE HINGE

FIELD OF THE INVENTION

The present invention relates to a hinge used to mount a door to a frame. Specifically, the present invention relates to a hinge with an adjustment module that allows the adjustment of the position of the door with respect to the frame without removing the hinge from the door or frame. More specifically, the present invention relates to a cabinet hinge with an adjustment module having an internal cavity through which a mounting screw is used to adjust the position of a cabinet door with respect to a cabinet frame.

BACKGROUND OF THE INVENTION

Various arrangements are known for mounting a hinge to a door and frame. In a common arrangement a cabinet hinge includes a mounting structure (such as a mounting plate or door wing with a hinge cup) which is fastened to the cabinet door by one or more fasteners (such as mounting screws) and a frame wing which is fastened to the cabinet frame and is movably connected with the mounting structure. The mounting of a cabinet door to a cabinet frame requires that the door be properly aligned with the cabinet frame for suitable "fit" and operation of the door (and to provide intended visual appearance or aesthetic appeal). Many mounting arrangements require that wood screws or like fasteners be used to affix the hinge to the cabinet frame and cabinet door. For example, an installer is required to drill mounting holes for the wood screws. This requires precise positioning of the mounting holes by the assembler. Such precise positioning of the mounting holes may be difficult for an assembler due to inexact measurement, machine tool inaccuracies, and cabinet material variations (even if a drill template is used). Therefore, a cabinet hinge that can be adjusted for alignment after the installation of the screws to some extent simplifies the installation process.

Known conventional cabinet hinge adjustment arrangements tend to be relatively complex. Moreover, many known adjustable hinges do not readily provide for adjustment in three directions (that is, in the transverse directions of height and width, i.e. along the edge surface, and in the normal direction of depth, i.e. out of the edge surface, of the cabinet frame or mounting edge) as would readily allow for easier installation and would overcome difficulties that may be posed by human, tool, machine, and manufacturing variations.

It would be advantageous to have a hinge of a relatively simple construction that overcomes the limitations presented by conventional cabinet hinge adjustment arrangements. It would also be advantageous to have an adjustable cabinet hinge that is relatively easy to manufacture (using a relatively small number of parts). It would further be advantageous to have an adjustable cabinet hinge that is relatively simple to install and is adjustable within a three dimensional space through a single adjustment module.

SUMMARY OF THE INVENTION

The present invention relates to a hinge for coupling a door to a frame, including a door wing to be mounted on the door, a frame wing to be associated with the frame and pivotally coupled to the door wing, and an adjustment module. The adjustment module has a base portion and an internal cavity extending through the base portion for receiving a fastener coupled to the frame. The frame wing is coupled to the base portion of the adjustment module so that positional adjustment of the frame wing with respect to the frame and of the door wing with respect to the door can be effected by the adjustment module.

BRIEF DESCRIPTION OF THE DRAWINGS

FIG. 6 is a side elevation cross-sectional view of the adjustment module, similar to FIG. 4, but shown adjusted to a generally central displacement in the normal direction (along the Z axis).

FIG. 7 is a side elevation cross-sectional view of the adjustment module, similar to FIG. 4, but shown adjusted to a maximum displacement in the normal direction (along the Z axis).

FIG. 8 is a front elevation cross-sectional schematic view of the adjustment module taken along line 8—8 of FIG. 5, showing an exemplary diagonal adjustment in a transverse plane (along X axis and Y axis) with respect to a fastener.

FIG. 9 is a perspective view of the cabinet hinge according to an alternative embodiment of the present invention (also showing axes of adjustment).

DETAILED DESCRIPTION OF PREFERRED EMBODIMENTS

Referring to the FIGURES, preferred and alternative embodiments of an adjustable hinge with an adjustment module for mounting a cabinet door to a cabinet frame are shown. It should be noted at the outset that the adjustment module disclosed and claimed herein can be used with any suitable type of hinge arrangement for cabinets or other systems, including both concealed and unconcealed hinge arrangements, as well as other arrangements known to those skilled in the art who may review this disclosure.

Figure 1:
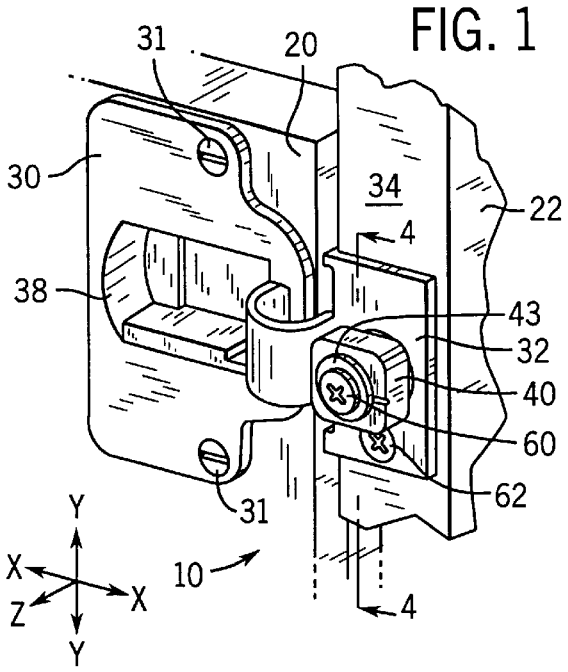
FIG. 1 is a perspective view of a cabinet hinge according to a preferred embodiment of the present invention (also showing axes of adjustment)

With reference to FIG. 1, a preferred embodiment of a three-way adjustable cabinet hinge 10 is shown. Hinge 10 is used to mount a cabinet door 20 (typically substantially solid) for selective pivotal movement between an opened position and a closed position with respect to a cabinet frame 22. Door 20 is shown in cut-away and may be made of any suitable material for a cabinet door including but not limited to wood, melamine, pressboard, metal, plastic, etc. In the embodiments shown in the FIGURES, cabinet door 20 is of an overlay type, as is described in U.S. Pat. No. 5,355,557

(entitled "CONCEALED SELF-CLOSING HINGE WITH INTEGRAL HINGE PIN MEANS") issued to Cress et al. on Oct. 18, 1994, and incorporated by reference herein. However, it should be acknowledged that according to alternative embodiments the hinge could be used with a wide variety of other types of doors (and frames). For example, as shown in FIG. 9, cabinet hinge 10*a* could be employed in connection with a non-overlay door 70 pivotally coupled to a frame 72.

Referring to FIG. 1, hinge 10 includes a door wing 30 with a hinge cup 38 pivotally coupled to a frame wing 32. According to the preferred embodiment, hinge cup 38 is adapted to be mounted into and around a substantially circular bore or recess (not shown) in the inner surface of door 20 (according to alternative embodiments hinge cup 38 may be adapted to fit into other bore geometries, and is not limited to the substantially circular). Door wing 30 is partially embedded in door 20 and held fixed to door 20 by fasteners shown as screws 31. Hinge 10 also includes frame wing 32, which is adapted to be mounted to an edge 34 of frame 22. According to a preferred embodiment (for a concealed hinge) hinge cup 38 is substantially embedded in door 20 and frame wing 32 is mounted to edge 34 of frame 22, so as to conceal the hinge from ordinary view (when viewed from the front of the cabinet). Door wing 30 is pivotally coupled with frame wing 32. A closing mechanism as shown in FIG. 1 is used in the preferred embodiment, however, according to alternative embodiments, a hinge arrangement (shown in FIG. 9) employing a pintle 74 (and without the hinge cup) or other hinge arrangement may be employed.

Hinge 10 also includes an adjustment module 40 and a mounting screw 60. In a preferred embodiment the hinge may further include a securing screw 62 to retain the alignment or position of the hinge (e.g. after adjustment). As shown in FIG. 1, adjustment module 40 is provided for adjustment within a three-dimensional adjustment space. The adjustment space (i.e. range of adjustment provided by the adjustment module) may conveniently be described with respect to a conventional Cartesian coordinate system having X, Y, and Z axes. As shown in the FIGURES, the X and Y axes define a transverse plane along the edge of the frame. The Z axis defines a direction normal to (i.e. away from) the edge of the frame. Movement in the normal (or Z) direction can conveniently be described with reference to edge 34, with minimum displacement in the normal (or Z) direction defined as when the frame wing is positioned at or upon the edge of the cabinet frame (see FIG. 5). It should be noted, however, using these axes to describe the hinge is not intended to suggest that adjustment is limited to movement along these axes. As is apparent from the FIGURES, movement or adjustment is possible in any direction within the three-dimensional adjustment space provided by the adjustment module (compare, for example FIGS. 5 and 7–8).

Figure 3:
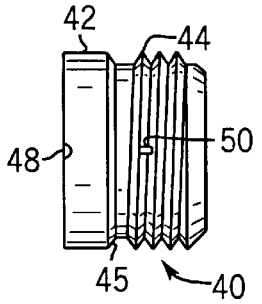
FIG. 3 is a side elevation view of the adjustment module.
Figure 2:
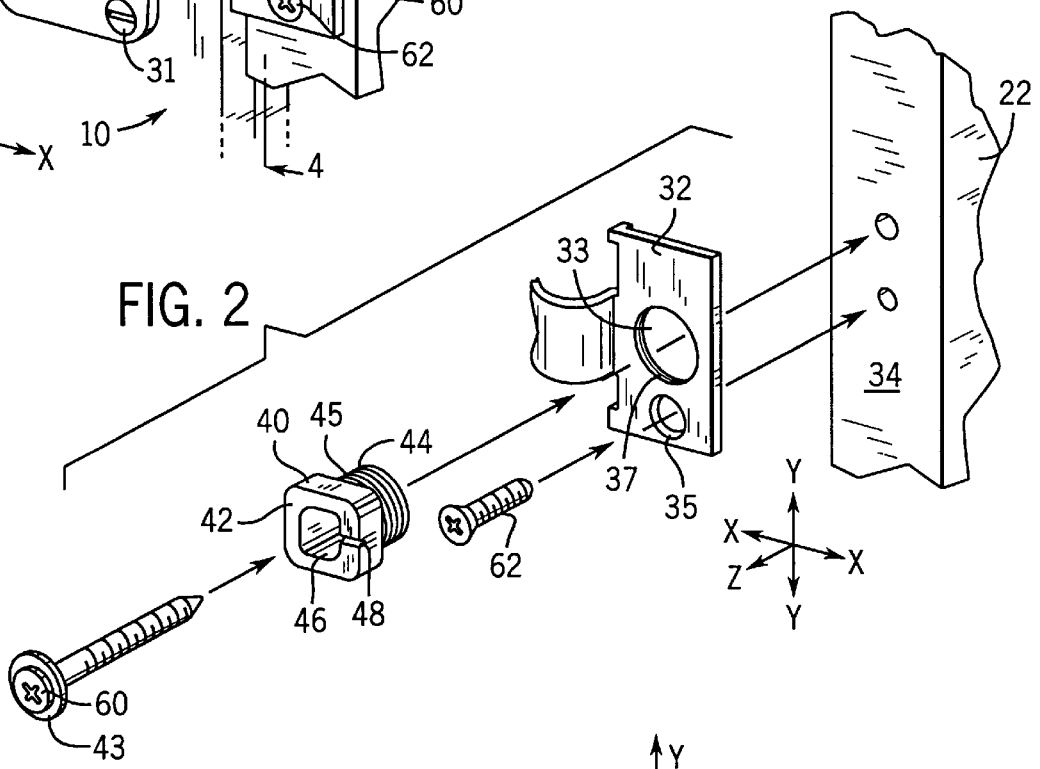
FIG. 2 is an exploded perspective view of the cabinet hinge of FIG. 1 showing the installation of a frame wing onto a cabinet frame (shown in cut-away) with an adjustment module (also showing axes of adjustment).
Figure 10:
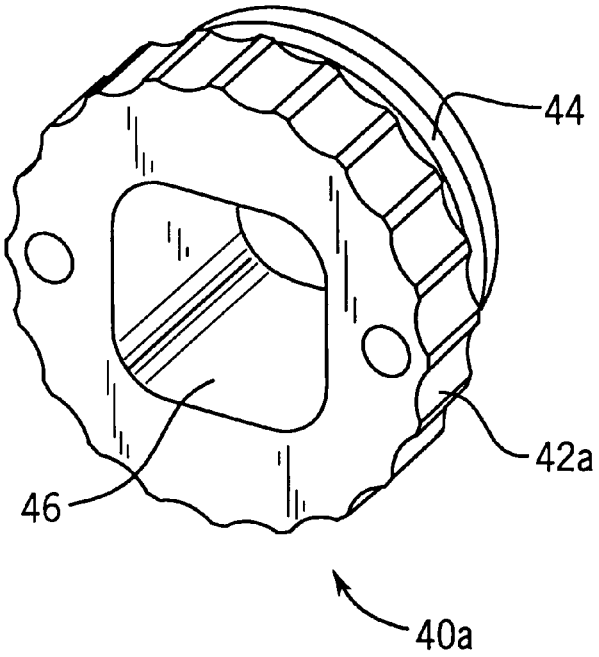
FIG. 10 is a perspective view of an adjustment module according to an alternative embodiment of the present invention.
Figure 11:
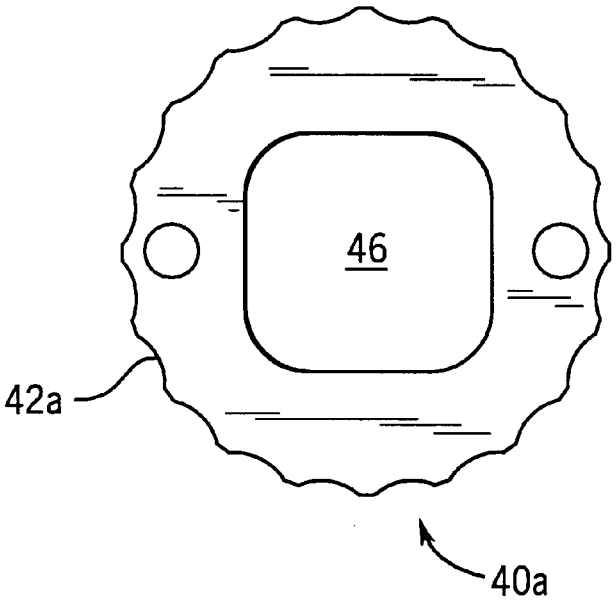
FIG. 11 is a front elevation view of the adjustment module of FIG. 10.

As shown in FIGS. 2 and 3, according to a preferred embodiment, adjustment module 40 includes an adjustment portion 42, a base portion 44, a cavity 46, a locating mark 48 and an interference projection 50. Adjustment portion 42 has a configuration (e.g. shape) that facilitates gripping or otherwise grasping by an installer or assembler for making rotational adjustment. In a preferred embodiment, the outer configuration of adjustment portion 42 is substantially rectangular. However, according to alternative embodiments any other configuration that facilitates gripping or other purposes may be used including, but not limited to, but round, scalloped, star-shaped, oval, octagonal, or hexagonal (or simply cylindrical), as shown for example in FIGS. 10 and 11 showing an adjustment module 40*a* having a scalloped adjustment portion 42*a*. Base portion 44 is substantially cylindrical having an external circumferential thread. Adjustment module 40 includes cavity 46 within which mounting screw 60 is installed (i.e. to frame 22). According to a preferred embodiment, cavity 46 is of a substantially rectangular configuration with an enclosed perimeter (see, e.g., FIGS. 2 and 8). However, according to alternative embodiments, the cavity of the adjustment module may have any of a variety of other configurations including, but not limited to, cylindrical oblong, oval, star-shaped, hexagonal, octagonal, etc., and may have a partially open perimeter (so long as it does not interfere with the requisite structural integrity). In a preferred embodiment, base portion 44 of adjustment module 40 includes interference projection 50 to enhance the "fit" between the base portion and the structure into which adjustment module 40 may be set. Interference projection 50 is shown located intermediate of the end of adjustment module 40 for supplemental holding or tightening when adjustment module is installed. (The interference projection may also be used for providing a holding force for the adjustment module in shipment of the hinge.) In any preferred embodiment, adjustment module 40 may include locating mark 48 to be used by an assembler (installer) or adjuster to indicate the orientation of adjustment module 40 before, after and during adjustment. Locating mark 48 is an essentially visual indicator and may include, but is not limited to, a notch as depicted in FIG. 3, or a dot, slot, ridge, coloring, marking or the like. In a preferred embodiment, adjustment module 40 is made from Nylon 6/6 with 33 percent glass, but other suitable materials may be used including, but not limited to, zinc die cast ASTM AG40A or other suitable metals, ceramics, polymers, or other material that provide sufficient rigidity and structural integrity.

As depicted in FIG. 2, frame wing 32 includes an adjustment module aperture 33. (In an alternative embodiment, a securing screw aperture 35 is also provided). (Frame wing 32 is preferably made from cold rolled one-pass steel, but may be made from other suitable materials such as other metals, ceramics, and polymers.) Adjustment module aperture 33 has an internal thread 37 configured to coact with the circumferential thread on base portion 44 of adjustment module 40. The circumferential thread of the adjustment module and the internal thread of the frame wing may be scaled or calibrated to reduce or increase the number of rotations required to move the adjustment module a given distance in the normal direction (Z axis) with respect to the frame and/or frame wing. (Securing screw aperture 35 is designed to accommodate securing screw 62.) Frame wing 32 is mounted on frame 22 by installing adjustment module 40 into adjustment module aperture 33. Mounting screw 60 is then installed through cavity 46 in adjustment module 40 and screwed into edge 34 of frame 22. Mounting screw 60 may be provided with a head having a diameter greater than the width of cavity 46, or alternatively will include a washer head or a washer 43 (as depicted in FIGS. 1, 2, 4 through 7, and 9), such that when mounting screw 60 is tightened (by screwing it into frame edge 34), washer 43 bears against the outer (normal) surface of adjustment portion 42 of adjustment module 40 to secure frame wing 32 in its relative position with respect to frame 22.

Once mounting screw 60 is screwed into position, it may be loosened slightly such that adjustment module 40, and with it the position of frame wing 32, can be adjusted in any of the directions within the adjustment space. FIG. 6 depicts frame wing 32 adjusted to a central position in the transverse direction, and also adjusted to a medium position with respect to edge 34 in the normal (or Z) direction. As depicted in FIG. 6, mounting screw 60 is holding adjustment module 40 and frame wing 32 such that mounting screw 60 is substantially in the center of cavity 46 with respect to a transverse direction (the Y direction). Also as depicted in FIG. 6, frame wing 32 is adjusted to a medium position with respect to the normal (or Z) direction, whereby frame wing 32 is mounted not flush with edge 34 of frame 22.

Figure 4:
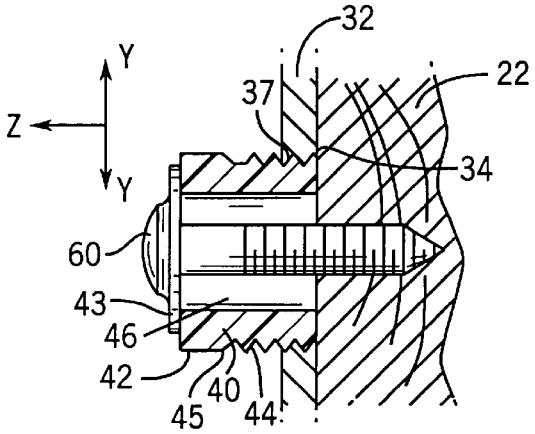
FIG. 4 is a side elevation cross-sectional view of the cabinet hinge taken along line 4—4 of FIG. 1 (shown holding the frame wing to the cabinet frame (shown in cut-away) by a mounting screw) shown adjusted to a minimum displacement in a normal direction (along the Z axis).
Figure 5:
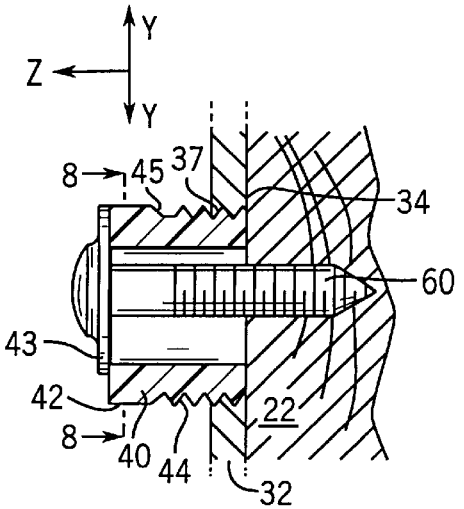
FIG. 5 is a side elevation cross-sectional view of the adjustment module, similar to FIG. 4, but shown adjusted to a maximum displacement in a transverse direction (along the Y axis).

FIG. 4 is similar to FIG. 6 in that it depicts adjustment module 40 and frame wing 32 being held in a central position with respect to a transverse direction (the Y direction) as in FIG. 6. However, frame wing 32 is depicted as being adjusted to be at its minimum displacement in the normal direction such that frame wing 32 is flush with and abutting edge 34 of frame 22. FIG. 7 also shows adjustment module 40 and frame wing 32 being held in a central position with respect to the X transverse (Y) direction as in FIG. 6. However, FIG. 7 also depicts a maximum displacement, in the normal (Z) direction, of frame wing 32 such that frame wing 32 is at a maximum distance from edge 34 of frame 22. When frame wing 32 is at its maximal displacement away from edge 34 of frame 22, it is stopped from going beyond such a maximum displacement by a shoulder 45 of adjustment module 40. At this maximal displacement, shown in FIG. 7, shoulder 45 abuts frame wing 32. Shoulder 45 is designed to extend outside the perimeter of adjustment module aperture 33. FIG. 5 is similar to FIG. 4 in that it depicts frame wing 32 being at a minimum displacement in the normal (Z) direction such that the frame wing is flush with and abutting edge 34 of frame 22. However, FIG. 5 depicts adjustment module 40 and frame wing 32 being held by mounting screw 60 at a maximum displacement in one transverse (Y) direction. Finally, FIG. 8 depicts adjustment module 40 being at various positions within a plane parallel to that formed by the transverse (X and Y) axes, in phantom lines and otherwise. (Two transverse axes, X and Y, are defined as references for similar transverse adjustment within the cavity of the adjustment module.) The adjustment positions shown are not the only positions allowable, since the adjustment module can be adjusted to an infinite number of positions defined by the adjustment space provided by cavity 46.

In a preferred embodiment, once frame wing 32 has been satisfactorily adjusted to a desired position, securing screw 62, depicted in FIGS. 1 and 2, may be used to more firmly affix frame wing 32 in the desired position for increased strength and rigidity of the hinge mounting arrangement to frame 22.

It is understood that, while the detailed drawings and specific examples given describe preferred exemplary embodiments of the present invention, they are for the purpose of illustration only. The apparatus and method of the invention is not limited to the precise details and conditions disclosed. According to alternative embodiments, the other elements of the hinge (and associated hardware) may be modified in a wide variety of configurations that nonetheless permit use of the adjustment module. Alternatively, the relationship between the frame wing (and the frame) and the door wing (and door) may be reversed. According to alternative embodiments, the hinge may be used to mount a variety of types of doors (or the like) to a variety of frames, including but not limited to cabinet doors and frames. Various changes of these or other types may be made without departing from the spirit of the invention and its embodiments.

What is claimed is:

1. A hinge for coupling a door to a frame, comprising:

a first wing member having an aperture and to be coupled to one of the frame and the door;

a second wing member to be coupled to the other of the frame and the door and pivotally coupled to the first wing member; and an adjustment module having a base portion and an internal cavity extending through the base portion, and having a longitudinal axis extending therethrough;

a fastener for securing to one of the frame and the door, the fastener having a head portion of a size at least partially larger in dimension than the internal cavity of the adjustment module and a shaft portion with a diameter substantially smaller than the internal cavity of the adjustment module;

wherein the internal cavity of the adjustment module is configured to receive the fastener so that the shaft portion of the fastener is selectively movable relative to the adjustment module in a lateral plane substantially perpendicular to the longitudinal axis of the adjustment module; and wherein the aperture of the first wing member is substantially larger than the diameter of the shaft portion of the fastener and the first wing member is coupled to the base portion of the adjustment module with the base portion of the adjustment module selectively movable relative to the aperture in a direction substantially in alignment with the longitudinal axis of the adjustment module so that positional adjustment of the first wing member with respect to one of the frame and the door can be effected by the adjustment module, in three orthogonal directions.

2. The hinge of claim 1 wherein the first wing member is coupled to the base portion of the adjustment module so that adjustment of the position of the door with respect to the frame may be made in a direction along the longitudinal axis by adjusting the position of the first wing member with respect to the adjustment module.

3. The hinge of claim 1 wherein the first wing member is coupled to the base portion of the adjustment module so that adjustment of the position of the door with respect to the frame may be made within a transverse plane, orthogonal to the longitudinal axis, by adjusting the position of the adjustment module with respect to the frame.

4. The hinge of claim 1 wherein the adjustment module is threadably connected to the first wing member.

5. The hinge of claim 1 wherein the fastener is a screw.

6. The hinge of claim 1 wherein the internal cavity of the adjustment module is of a generally orthogonal cross-section defined by a substantially continuous outer perimeter.

7. The hinge of claim 1 wherein the adjustment module has an adjustment portion having an external shape that facilitates adjusting of the adjustment module.

8. The hinge of claim 7 wherein the adjustment module has a shoulder between the base portion and the adjustment portion, the shoulder creating an interference stop between the adjustment module and the first wing member such that the adjustment portion cannot enter the aperture.

9. The hinge of claim 7 wherein the adjustment module has a locating mark on the adjustment portion to indicate the relative orientation of the adjustment module.

10. The hinge of claim 1 wherein the base portion of the adjustment module has an interference projection to provide tightness at least at a first position.

11. The hinge of claim 7 wherein the adjustment portion of the adjustment module has an outer surface which is substantially rectangular.

12. The hinge of claim 1 wherein the internal cavity of the adjustment module has a substantially circular shaped cross section.

13. The hinge of claim 1 wherein the base portion of the adjustment module has exterior threads.

14. The hinge of claim 7 wherein the adjustment portion of the adjustment module has an outer surface which is substantially round.

15. The hinge of claim 7 wherein the adjustment portion of the adjustment module has an outer surface which is scalloped.

16. The hinge of claim 1 wherein the first wing member includes an aperture for accepting a fixing screw.

17. An adjustment module for the adjustment of a hinge to provide for alignment of a door relative to a frame, the hinge having a door wing mounted to the door and pivotally coupled to a frame wing, the frame wing having an aperture and being coupled to the adjustment module for selectively positioning within the aperture of the frame wing, the adjustment module comprising:

a base portion having an outer section configured for selective engagement with the aperture; and an internal cavity, extending through the base portion, and defining a longitudinal axis, the internal cavity being configured for receiving a fastener, the fastener having a head portion and a shaft portion, the head portion being of a shape that is dimensioned to be incapable of passage into the internal cavity when the fastener is installed, and the shaft portion having a diameter substantially smaller than the internal cavity so that the fastener is installed in substantial alignment with the longitudinal axis and the base portion is selectively movable in a lateral plane relative to the frame wing by the relative position of the fastener within the internal cavity; and wherein the aperture is larger than the adjustment module and substantially larger than the diameter of the shaft portion of the fastener and the adjustment module is adapted to provide adjustment of the frame wing relative to the frame in three orthogonal directions.

18. The adjustment module of claim 17 wherein the adjustment module is threadably connected to the frame wing.

19. The adjustment module of claim 17 wherein the fastener is a screw.

20. The adjustment module of claim 17 wherein the internal cavity of the adjustment module is of a generally orthogonal cross-section.

21. The adjustment module of claim 17 wherein the adjustment module has an adjustment portion having an external shape that facilitates adjusting of the adjustment module.

22. The adjustment module of claim 21 wherein the adjustment module has a shoulder between a base portion and the adjustment portion, the shoulder creating an interference stop between the adjustment module and the frame wing such that the adjustment portion cannot enter the aperture.

23. The adjustment module of claim 21 wherein the adjustment module has a locating mark on the adjustment portion to indicate the relative orientation of the adjustment module.

24. The adjustment module of claim 17 wherein the base portion has an interference projection on an external thread to provide tightness at least near a first position.

25. The adjustment module of claim 21 wherein the adjustment portion of the adjustment module has an outer surface which is substantially rectangular.

26. The adjustment module of claim 17 wherein the base portion of the adjustment module has external threads.

27. The adjustment module of claim 26 wherein the internal cavity of the adjustment module has a substantially rectangular cross-section.

28. The adjustment module of claim 21 wherein the adjustment portion of the adjustment module has an outer surface which is substantially round.

29. The adjustment module of claim 21 wherein the adjustment portion of the adjustment module has an outer surface which is scalloped.

30. A cabinet hinge assembly, comprising:

a door hinge to be mounted on a cabinet door;

a frame hinge with an internally threaded aperture and to be mounted on a cabinet frame and rotatably coupled to the door hinge; and an adjustment module including a substantially cylindrical, externally threaded base portion, an adjustment portion having an external shape that facilitates adjusting of the adjustment module, and an internal cavity extending through the adjustment portion and the base portion for receiving a mounting screw for mounting to the cabinet frame and having a head portion of a shape larger in at least one dimension than the internal cavity of the adjustment module and a shaft portion with a diameter substantially smaller than the internal cavity of the adjustment module;

wherein the internally threaded aperture of the frame hinge is configured for selective engagement with the externally threaded base portion of the adjustment module and the adjustment portion of the adjustment module is configured for selective movement relative to the mounting screw mounted to the cabinet frame so that the adjustment module is adapted to provide adjustment of the frame hinge relative to the cabinet frame in three orthogonal directions.

* * * * *